US006062455A

United States Patent [19]

Giannuzzi et al.

[11] Patent Number: 6,062,455

[45] Date of Patent: May 16, 2000

[54] CARTRIDGE STRIP MAGAZINE FOR POWDER-ACTUATED FASTENER SETTING TOOL

[75] Inventors: Louis N. Giannuzzi, Stamford, Conn.; Anthony C. Giannuzzi, 28 Doral Farm Rd., Stamford, Conn. 06902

[73] Assignee: Anthony C. Giannuzzi, Stamford, Conn.

[21] Appl. No.: 09/130,031

[22] Filed: Aug. 6, 1998

[51] Int. Cl.[7] ..... B25C 1/14

[52] U.S. Cl. ..... 227/10; 227/9

[58] Field of Search ..... 227/10, 9, 11; 89/35.01, 35.02, 26, 1.14; 102/531, 466, 281

[56] References Cited

U.S. PATENT DOCUMENTS

| | | | |
|---|---|---|---|
| 3,552,625 | 1/1971 | Udert | 227/10 |
| 3,709,421 | 1/1973 | Kolmar | 227/10 |
| 3,743,159 | 7/1973 | Schneider | 227/10 |
| 4,098,169 | 7/1978 | Gawlick et al. | 89/35.01 |
| 4,162,033 | 7/1979 | Pomeroy | 227/10 |
| 4,565,114 | 1/1986 | Burdick et al. | 89/35.01 |
| 4,655,380 | 4/1987 | Haytayan | 227/10 |
| 5,271,309 | 12/1993 | Cornett | 227/10 |
| 5,767,434 | 6/1998 | Hirtl et al. | 227/10 |

*Primary Examiner*—Peter Vo
*Assistant Examiner*—Jim Calve
*Attorney, Agent, or Firm*—Michael Ebert

[57] ABSTRACT

A cartridge strip magazine for successively feeding cartridges into the breech of a powder-actuated fastener setting tool. When a cartridge in alignment with the breech is fired, the resultant expanding gas acts to propel a drive piston to launch a fastener. The inlet to the breech is provided with a frusto-conical upper entry section and an inwardly offset frusto-conical lower section having the same slope as the upper section. The magazine is molded of a strip of resilient plastic material having a row of noses projecting therefrom, each nose socketing a cartridge and being adapted to nest within the inlet of the tool breech. Each nose is formed with an outer wall having a frusto-conical lower section which when the nose is nested within the breech abuts and conforms to the lower section of the breech, and an outwardly-offset frusto-conical upper section that then abuts and conforms to the upper section of the breech.

8 Claims, 3 Drawing Sheets

CARTRIDGE STRIP MAGAZINE FOR POWDER-ACTUATED FASTENER SETTING TOOL

BACKGROUND OF INVENTION

1. Field of Invention

This invention relates generally to powder-actuated fastener setting tools adapted to drive fasteners such as nails or pins, into concrete or other forms of masonry, and more particularly, to a cartridge strip magazine adapted to cooperate with the tool carrying a row of cartridges to be fed successively into the breech of the tool.

2. Status of Prior Art

Known types of powder-actuated fastener setting tools, such as the tool disclosed in the Popovich et al. U.S. Pat. No. 5,273,198, are provided with a forwardly-biased barrel slidable within a cylindrical housing. For reasons of safety, the tool is operable only when the muzzle of the barrel is pressed against a concrete surface to advance the breech of the barrel rearwardly whereby when the cartridge then in line with the breech is fired, the resultant explosive force acts to propel a driving piston to launch a fastener.

In a powder-actuated tool of the type disclosed in the Burdick et al. U.S. Pat. No. 4,565,114, the breech of the tool has a conical inlet and the tool includes a magazine feed channel perpendicular to the main axis of the tool. This channel accommodates a cartridge strip magazine, allowing this magazine to successively place the cartridges carried by the magazine in alignment with the breech in readiness to be fired.

As noted in the Burdick patent, it has long been the practice in cartridge strip magazines for a powder-actuated fastener setting tool to socket each cartridge in a frusto-conical shroud formed of resilient plastic material projecting from the strip. This plastic shroud which nests within the conical inlet of the breech of the tool has the same or a greater cone angle. An advantage of this plastic shroud is that because of its resilience, it will self-eject and not require a mechanical ejector.

But the main drawback of a conically-shrouded multiple round magazine of this known type is that it has a tendency to misfire or leak gas. The leakage of gas reduces the effective explosive force produced when a cartridge in alignment with the breech is fired. In order to drive a fastener fully into hard concrete or other masonry that is difficult to penetrate, it is essential that the available explosive force be fully exploited.

To obviate this drawback, Burdick provides a cartridge strip magazine for a powder-actuated tool having a row of non-conical, stepped plastic shrouds or projections which create cartridge-receiving sockets at spaced positions along the strip. When a non-conical, stepped projection carrying a cartridge is nested within the frusto-conical inlet in the breech of the tool, the leading edges of the multi-stepped projection make contact with the conical surface of the breech inlet to produce a series of spaced plastic sealing rings. These rings prevent the expanding gas generated when the cartridge is fired, from leaking out through the space between the breech inlet and the stepped projection nested therein.

The Burdick series of plastic sealing rings which make point contact with the conical wall of the breech inlet at spaced positions along the wall do not assure the total avoidance of gas leakage, for each point contact seal can be overcome by the high-pressure expanding gas produced by the exploding powder.

It must be borne in mind that when the cartridge powder is exploded, the resultant expanding gas is confined to the small breech region between the cartridge and the driving piston in the barrel. At the instant of the explosion, the pressure of the gas in this confined region is enormous, and it is then capable of bypassing even a strong gas seal.

SUMMARY OF INVENTION

In view of the foregoing, the main object of this invention is to provide in a powder-actuated fastener setting tool and a cartridge strip magazine for successively feeding cartridges into the breech of the tool, an effective sealing means to ensure that when a cartridge in alignment with the breech is fired, virtually all of the resultant expanding gas acts to drive a fastener into a masonry body.

More specifically, an object of the invention is to provide sealing means for a powder-actuated tool and a cartridge strip magazine in the form of a double seal having a cavity interposed therebetween, whereby should pressurized gas resulting from the explosion leak through the first seal into the cavity, its pressure will be reduced therein to render it almost incapable of overcoming the second seal.

Also an object of this invention is to provide a powder-actuated fastener setting tool having a breech whose inlet is formed by offset frusto-conical upper and lower sections having about the same cone angles adapted to nest the nose of a magazine in which a cartridge is socketed, which nose has complementary frusto-conical sections.

Yet another object of the invention is to provide a cartridge strip magazine for a powder-actuated tool that is no more expensive to manufacture than a conventional magazine, yet affords effective sealing means to prevent the escape of gas and the consequent reduction of driving power.

A further object of the invention is to provide an improved feed mechanism for stepping the cartridge magazine to the next firing position.

Briefly stated, these objects are attained by a cartridge strip magazine for successively feeding cartridges into the breech of a powder-actuated fastener setting tool. When a cartridge in alignment with the breech is fired, the resultant expanding gas acts to propel a drive piston to launch a fastener. The inlet to the breech is provided with a frusto-conical upper entry section and an inwardly offset frusto-conical lower section having a similar slope as the upper section to define at the junction of these sections an inlet step.

The magazine is molded of a strip of resilient plastic material having a row of noses projecting therefrom, each nose socketing a cartridge and being adapted to nest within the inlet of the tool breech. Each nose is formed with an outer wall having a frusto-conical lower section which when the nose is nested within the breech abuts and conforms to the lower section of the breech, and an outwardly offset frusto-conical upper section that abuts and conforms to the upper section of the breech. The junction between the offset lower or upper sections of the nose defines a nose step that is displaced from the inlet step to create a cavity therebetween.

When a nose-socketed cartridge nested within the breech inlet is exploded, the resultant expanding gas which acts to propel the drive piston of the tool is prevented from escaping by a double seal formed by the abutting lower and upper sections of the nose and breech. Any gas which leaks through the lower seal into the cavity is there reduced in pressure and is then incapable of overcoming the upper seal.

BRIEF DESCRIPTION OF DRAWING

For a better understanding of the invention, as well as other objects and further features thereof, reference is made to the following detailed description to be read in conjunction with the accompanying drawing, wherein.

DESCRIPTION OF INVENTION

Figure 1:
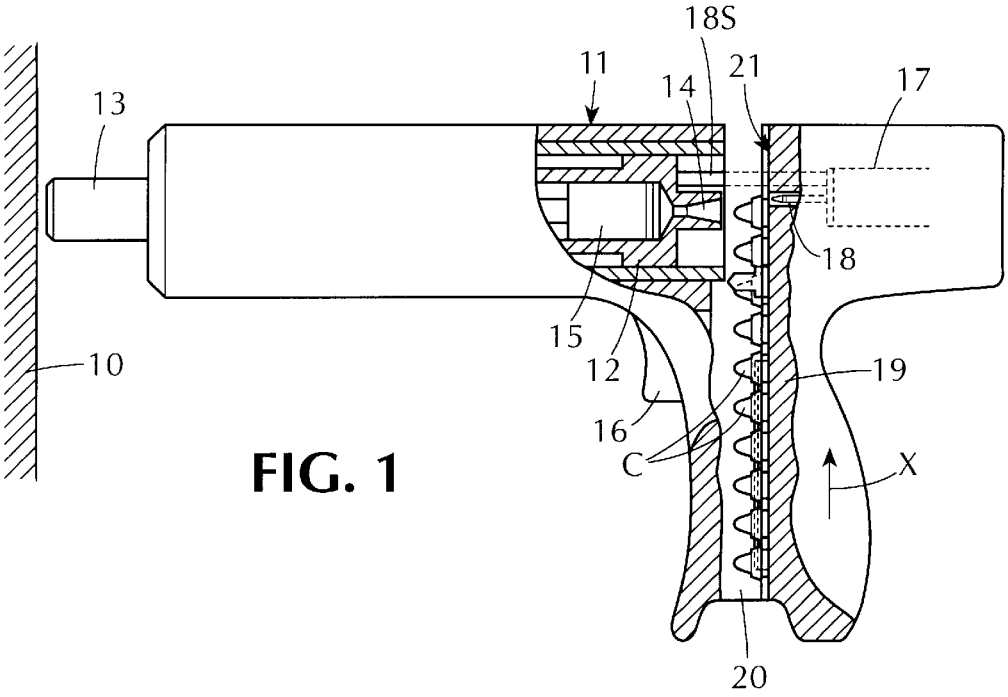
FIG. 1 illustrates, partly in section, a powder-actuated fastener setting tool in accordance with the invention adapted to fire cartridges carried by a cartridge strip magazine.

The Powder Actuated Tool:

Referring now to FIG. 1, there is shown a powder-actuated fastener setting tool in accordance with the invention which operates in conjunction with a cartridge strip magazine for driving a fastener, such as a nail or pin, into a concrete body 10 or other form of hard masonry that is difficult to penetrate. The tool and magazine therefor shown in FIG. 1 are similar to the tool and magazine disclosed in the Frommelt et al. U.S. Pat. No. 5,251,532 and operates in a similar manner, except that included therein is a double gas sealing means, to be later described, that is lacking in the Frommelt patent.

The tool includes a cylindrical housing 11 in which is axially slidable a forwardly-biased barrel 12 whose muzzle 13 projects from the front end of housing 11, the barrel being coaxial with the housing.

When muzzle 13 of the tool is pressed by an operator against the surface of masonry 10 to render the tool operable so that a fastener can be driven into the masonry, barrel 12 is then rearwardly advanced to cause a breech 14 at the rear end of the barrel to receive a cartridge C then in alignment with the breech, so that the cartridge becomes nested within the breech inlet in readiness to be fired.

Slidable within barrel 12 is a driving piston 15 which when the cartridge nested within the breech is exploded, the piston is propelled by the resultant expanding gas to drive a fastener into the masonry.

The tool includes a trigger 16 which when pulled by a finger of the operator, initiates the operation of a firing device 17 which projects a firing pin 18 to cause it to strike the rear of the cartridge C then nested within the breech. Firing device 17 is provided with a retractable safety pin 18S which normally engages the rear end of barrel 12. When muzzle 13 is pressed against the masonry to advance the barrel, the rearwardly advancing barrel pushes in the safety pin to render firing device 17 operative so that when trigger 16 is pulled, firing pin 18 then strikes cartridge C to cause the powder therein to explode.

Extending downwardly from housing 11 of the tool is a handle 19 that is generally perpendicular to the firing direction. Extending through handle 19 and the housing 11 to which it is joined is a guide channel 20 for guiding a cartridge strip magazine 21 carrying a row of cartridges C. The entry or insertion end of guide channel 20 is at the lower end of handle 19, its feed direction upwardly through the channel being indicated by arrow X.

In operation, a feed mechanism (not shown) acts to move the magazine stepwise in the channel so as to successively bring cartridges C into alignment with breech 14 of the tool. When muzzle 13 is pressed against the surface of masonry 10 by the operator holding the tool to cause barrel 12 to rearwardly advance axially whereby breech 14 at the rear of the barrel then receives and nests in its inlet a cartridge C, the tool is now cocked for firing. Hence when the trigger is pulled to explode the powder in the cartridge, the resultant expanding gas propels the driving piston 15 to drive a fastener into the masonry.

It is important to understand that a powerful force is necessary to fully drive a fastener into a masonry body, particularly when the masonry is a dense and very hard concrete. The power of the drive force depends on the explosive force of the fired cartridge, and if some of this force is dissipated because not all of the expanding gas is confined to the breech of the tool but escapes, then the force may not be sufficient to fully drive in the fastener. It is this problem to which the present invention is addressed.

The Sealing Means:

The concern of the present invention is with a powder-actuated tool and a cartridge strip magazine therefor that are provided with sealing means to ensure that virtually of the expanding gas resulting from an explosion of the cartridge powder is confined to the breech and therefore not dissipated.

Figure 4:
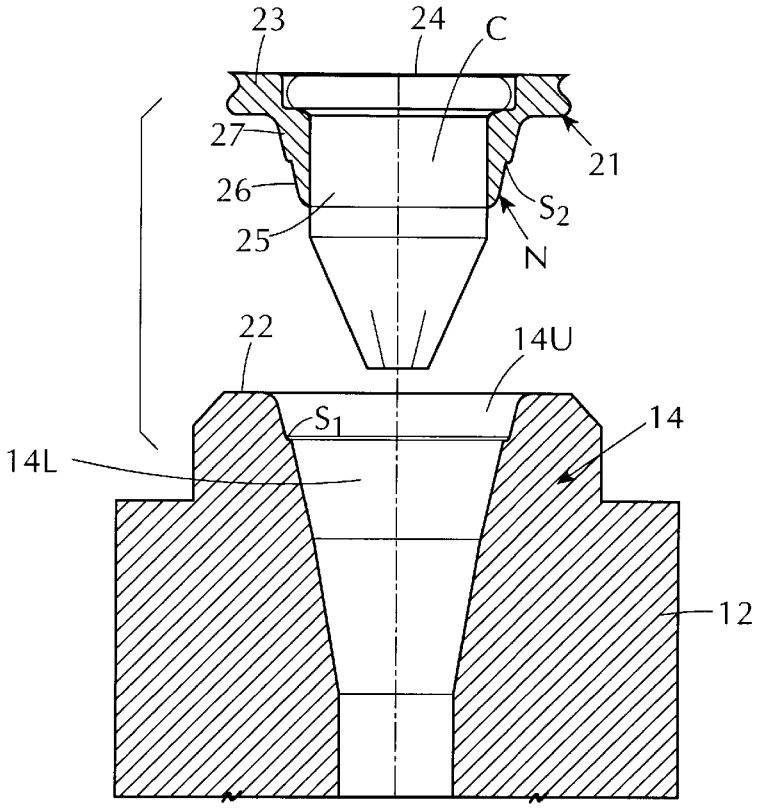
FIG. 4 is a section taken through the breech of the tool and through a nose projecting from the magazine in which a cartridge is socketed.

To this end, breech 14 at the rear end of barrel 12, as shown in FIG. 4, is provided with a flat head 22 and an upper entry section 14U counter-sunk in the head having a frusto-conical form. Inwardly offset with respect to upper section 14U is a frusto-conical lower section 14L having the same slope as the upper section. At the junction of upper section 14U and the offset lower section 14L is an inlet step $S_1$.

Figure 2:
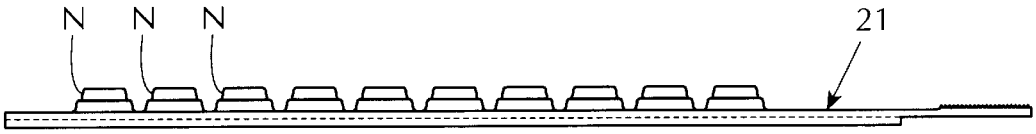
FIG. 2 is a side view of the magazine.
Figure 3:
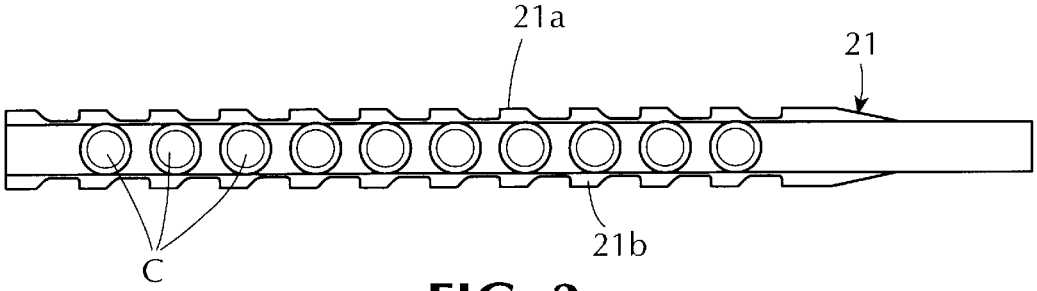
FIG. 3 is a plan view of the magazine.

As shown in FIGS. 2 and 3, cartridge strip magazine 21 is formed of an elongated strip of resilient plastic material, such as PVC or polyethylene whose opposing long edges are provided with tooth like-projections 21*a* and 21*b* in a sprocket formation which are engageable by a feed mechanism to advance the magazine stepwise through the guide channel in the handle of the tool.

Cartridges C carried by strip 21 are socketed in a row of equi-spaced noses N projecting from one side of the strip. Each nose N which is molded of resilient synthetic plastic material and is integral with the strip includes, as shown in FIG. 4, an annular shoulder 23 which when the nose is nested within the inlet of breech 14 then rests on head 22 of the breech. Cartridge C socketed in nose N has a head 24 which is received within annular shoulder 23 of the nose. The cylindrical body 25 of cartridge C is received within a tubular bore in nose N whose outer wall includes a lower section 26 having a frusto-conical shape. The conical tip T of the cartridge projects from its cylindrical body. Outwardly offset from the lower section 26 of the nose is a frusto-conical upper section 27 that merges with shoulder 23 and has the same slope of that of the lower sections. At the junction of the lower and upper sections of the nose is a step $S_2$.

Figure 6:
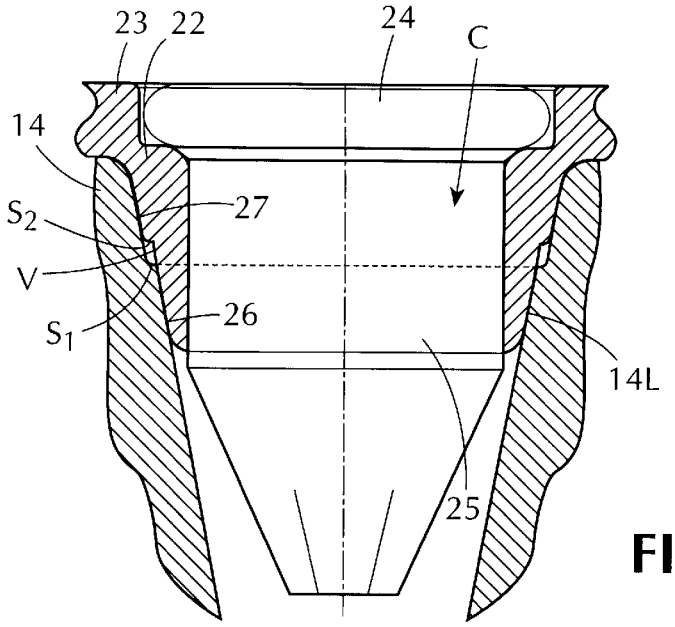
FIG. 6 shows a single nose nested in the breech of the tool to form a double seal to prevent the escape of gas.

The dimensions and shape of nose N are such that when, as shown in FIG. 6, the shoulder 23 of the nose rests on the head 22 of the inlet to breech 14, then the lower section 26 of the nose abuts and conforms to the lower section 14L of the breech inlet. And the upper section 27 of the nose then abuts and conforms to the upper section 14U of the breech inlet.

In order to achieve this abutting and conforming relationship of the upper and lower sections of the nose and of the inlet to the breech all of which have a frusto conical shape it is not essential that they have slopes that match perfectly. Because the nose is made of resilient plastic material, as long as the slope of the nose sections are close to the slope of the breech inlet sections when the resilient nose is pushed into the breech inlet its shape will then be made to conform thereto.

It is important to note that when, as shown in FIG. 6, nose N in which cartridge C is socketed is nested within the inlet of the breech 14, the step $S_1$ on the inlet is displaced from the step $S_2$ on the nose to create an internal cavity or void V. Thus when the nose is nested within the breech inlet, a double seal is created to prevent an expanding gas produced when the cartridge powder is exploded from escaping.

The first seal is created by the abutting lower sections of the nose and breech inlet, and the second seal by the abutting upper sections thereof.

When the cartridge is fired, the resultant expanding gas is under an exceptionally high pressure within the breech of the tool, and should some of this gas force its way through the lower seal, the gas will pass into cavity V where its pressure will be reduced. Hence the gas leaking into cavity V must be represurized to overcome the upper second seal and virtually no gas will escape through the magazine.

Figure 5:
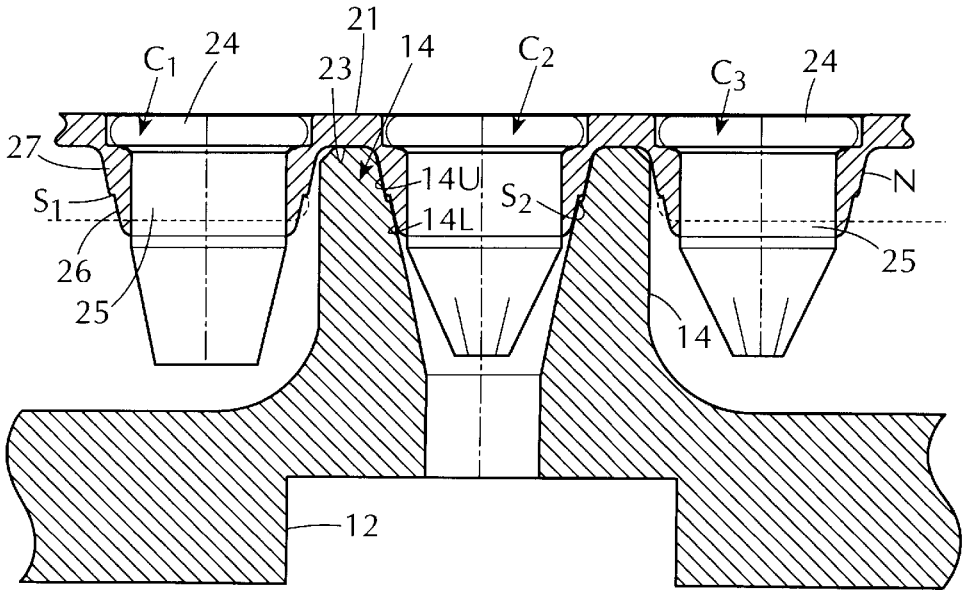
FIG. 5 shows a series of three magazine noses, one of which is nested within the inlet of the tool breech.

FIG. 5 illustrates the relationship of breech inlet 14 of the tool to a series of three cartridges $C_1$, $C_2$ and $C_3$ in the row thereof in magazine 21. Cartridge $C_1$ has already been exploded and therefore is now above the breech inlet, whereas cartridge $C_2$ which has yet to be fired is now nested within the breech inlet, while cartridge $C_3$ which is below the breech inlet is waiting to be advanced into the inlet. It is to be noted that because cartridge $C_2$ has yet to be fired whereas cartridge $C_1$ has already been fired, the conical projection on cartridge $C_1$ is dilated as a result of the explosion.

Breech 14, as shown in FIG. 5, is at the rear end of barrel 12 within which is slidable driving piston 15 for launching a fastener, as illustrated in FIG. 1. Hence when nose N in which cartridge $C_2$ is socketed is nested within the inlet of breech 14 and this cartridge is fired, all of the resultant expanding as is confined to breech 14 to propel the driving piston in barrel 12, and no gas is permitted by the double seal to escape from the inlet to the breech.

Magazine Feed Strip Mechanism:

In a typical cartridge strip magazine for a powder-actuated fastener setting tool, the strip as shown for example in the Gawlick et al. U.S. Pat. No. 4,098,169 (FIG. 1b) is provided along each of its long edges with a row of rectangular notches that define tooth-like projections.

In normal operation, when a cartridge carried by the strip has been fired, in order to then advance the strip to put a fresh cartridge in line with the breech of the tool, the muzzle barrel is manually reciprocated axially. This reciprocating movement of the barrel advances the strip while simultaneously repositioning the drive piston and recocking the firing mechanism. The trigger mechanism is then only required to trip the already spring-loaded firing pin. Since the trigger action is only required to trip the preloaded firing pin, little force is then demanded of the trigger finger of the operator.

In addition to manual powder-actuated tools of the type described above, installation tools have recently been developed which when fired, automatically reposition the drive piston while simultaneously recocking the firing pin. In these recently-developed tools, the trigger mechanism is then required to simultaneously trip the firing pin and index the cartridge strip.

Normally, a powder-actuated tool on a given work site acts to drive a large number of fasteners into the masonry. In order to do so, the operator of the tool must repeatedly pull the trigger, for with each pull, only one fastener is discharged from the muzzle of the tool. If therefore the design of the tool requires that with each pull of the trigger the operator must exert a heavy finger pressure, then with repeated operations the operator experiences an excessive degree of fatigue and will reach a point where he is no longer able to pull the trigger.

Figure 7:
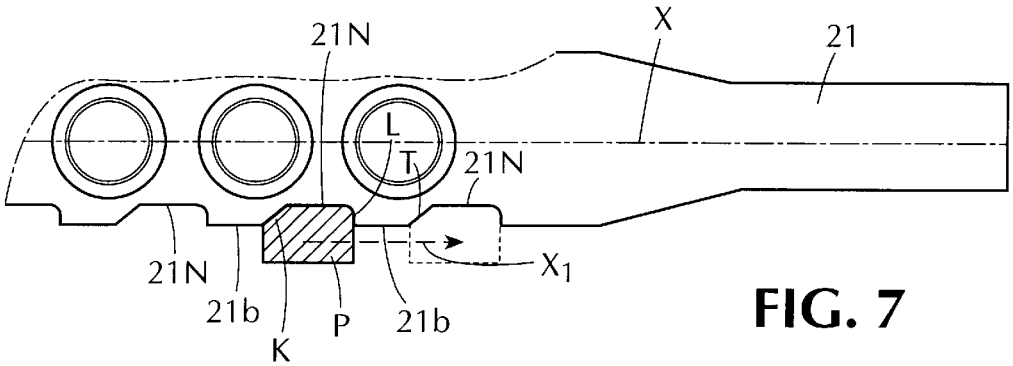
FIG. 7 illustrates the pawl of feed mechanism to advance the cartridge strip magazine to the next firing position.
Figure 8:
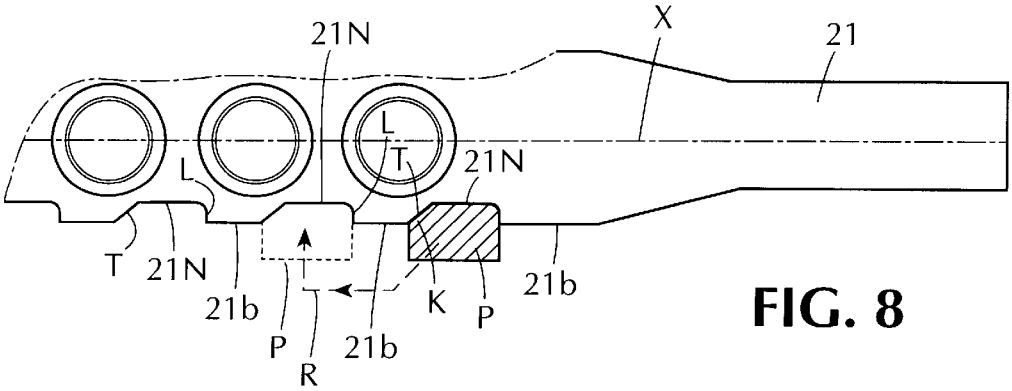
FIG. 8 shows the strip being advanced.

To overcome this difficulty and make it possible for an operator of an automatically resetting powder-actuated tool to employ a relatively low degree of finger pressure to pull the trigger, in a tool in accordance with the invention, cartridge strip magazine 21 is provided along its parallel opposing edges with a row of tooth-like projections 21*a* and 21*b*, as shown in FIGS. 7 and 8.

These projections or teeth, shown in FIGS. 7 and 8 only with respect to teeth 21*b* along one edge of the strip, are defined by notches 21N. Each notch 21N is generally rectangular in form except that its trailing end T is rearwardly sloped, whereas its leading edge L is a right angle.

It will be seen that pawl P of the feed mechanism has a rectangular cross section whose upper left corner K is chamfered at about a 45 degree angle. This angle matches the slope of trailing ramp edge T of notch 21N in which pawl P is received. Hence the upper section of pawl P which includes the angled corner K fits neatly into the notch, whereas the lower section of the pawl sticks out of the notch.

When the trigger of the tool is pulled, both the firing pin and the feed mechanism for the cartridge magazine are actuated thereby. While the cartridge is being fired, the feed mechanism simultaneously resets to drop pawl P into the next notch 21N on the strip, as shown in FIG. 8. Pawl P is made to drag out of notch 21N at a ramp angle thereto. This ramp angle depends on the slope of the trailing ramp edge T of notch 21N which defines the angled leading end of tooth 21*b*.

The reset path taken by pawl P when dragged out of notch 21N by the feed mechanism and dropped into the next notch on the strip is indicated by path R in FIG. 8. It will be seen in path R that pawl P which is held in the notch by a strong spring pressure, is dragged out of notch 21N at a ramp angle acute to the long axis X of the strip, this angle being determined by the ramp angle of the trailing edge T of the notch. When pawl P is fully out of notch 21N, it then drags along the face of tooth 21*b* in a path parallel to axis X until it reaches a point in line with the next notch 21N, at which point it drops into this notch in a path at right angles to axis X of the strip.

Because pawl P is dragged up a ramp at an angle from notch 21N, it is relatively easy to lift the pawl out of the notch when resetting the tool, and it takes less finger pressure on the part of the operator to do so. Hence with a feed mechanism and a cartridge strip magazine in accordance with the invention, an operator of the tool will not suffer from fatigue even after discharging into masonry a multitude of fasteners.

When the trigger is released and the breech moves away from the firing position, the spring-loaded feed finger causes pawl P, as shown in FIG. 7, to push the tooth 21*b* adjacent the notch 21N in which the pawl is received. This pushing action causes strip 21 to advance axially one step to bring the next cartridge in the strip in line with the breech of the tool.

The path taken by pawl P, when axially advancing the strip, is in a straight line $X_1$, which, as shown in FIG. 7, is parallel to the longitudinal axis X of the strip.

While there has been shown and described preferred embodiments of a cartridge and strip magazine for powder-actuated fastening setting tool in accordance with the invention, be appreciated that many changes may be made thereon within the spirit of the invention.

We claim:

1. In combination with a magazine strip loaded with a cartridge, a powder-actuated fastener setting tool having a breech in whose inlet is nested a nose projecting from the magazine strip in which the cartridge is socketed, the cartridge when fired then producing a gas in the breech which expands to drive a fastener into a masonry body, and means to confine the expanding gas to the breech and thereby prevent it from escaping through a space between said nose and said inlet, said means comprising:

A. a tool breech having an inlet formed by a frusto-conical upper entry section and an inwardly offset frusto-conical lower section, which forms an inlet step at a junction between the upper entry section and the lower entry section; and B. said magazine nose being formed of resilient plastic material having a lower frusto-conical section which when the nose is nested in the breech inlet then abuts and conforms to the lower section of the inlet to create a broad lower seal, and an outwardly offset upper frusto-conical section which forms a nose step at a junction between the lower frusto-conical section and the upper frusto-conical section and which then abuts and substantially conforms to the upper section of the inlet to create a broad upper seal which together with the lower seal acts to prevent the escape of the gas and wherein a zone is formed between the inlet step and the nose step in which gas leaking through the lower seal is depressurized therein.

2. In a tool and magazine as set forth in claim 1, in which the lower section of the breech inlet has a slope which has an angle that is substantially the same as the slope of the upper section thereof.

3. A tool and magazine as set forth in claim 1, in which the breech is at the rear end of a barrel that is slidable in a housing, said barrel having at its front end a muzzle which when pressed against the masonry body causes the barrel to axially advance to position the breech in operative relationship to the nose then in alignment with the breech.

4. A tool and magazine as set forth in claim 1, in which a driving piston is slidable in the barrel, and when the cartridge is exploded is propelled by the expanding gas to drive a fastener into the masonry body.

5. In a tool and magazine as set forth in claim 1, wherein said magazine strip is provided with a row of noses projecting therefrom, each socketing a cartridge.

6. In a tool and magazine as set forth in claim 5, having a handle in which there extends a guide channel to accommodate the magazine strip further including means to advance, the magazine strip stepwise to successively align the nose with the breech.

7. In a tool and magazine as set forth in claim 1, in which the strip of the magazine and the noses projecting from the strip are molded of resilient plastic material.

8. In a tool and magazine as set forth in claim 7, in which the plastic material is polyethylene.

* * * * *